US005250990A

United States Patent [19]

Fujimura et al.

[11] Patent Number: 5,250,990

[45] Date of Patent: Oct. 5, 1993

[54] IMAGE-BEARING MEMBER FOR ELECTROPHOTOGRAPHY AND BLADE CLEANING METHOD

[75] Inventors: Naoto Fujimura, Yokohama; Kiyoshi Sakai, Chofu; Teigo Sakakibara, Yokohama; Junichi Kishi, Tokyo, all of Japan

[73] Assignee: Canon Kabushiki Kaisha, Tokyo, Japan

[21] Appl. No.: 500,216

[22] Filed: Mar. 28, 1990

Related U.S. Application Data

[63] Continuation of Ser. No. 368,887, Jun. 20, 1989, abandoned, which is a continuation of Ser. No. 912,123, Sep. 29, 1986, abandoned.

[30] Foreign Application Priority Data

Sep. 30, 1985 [JP] Japan ..... 60-214700

[51] Int. Cl.[5] ..... G03G 15/00; G03G 21/00

[52] U.S. Cl. ..... 355/211; 355/296; 355/299; 430/125

[58] Field of Search ..... 118/651, 652; 15/1.5 R, 15/256.51, 256.52; 430/79, 83, 58, 66, 67, 125; 355/211, 212, 296, 299

[56] References Cited

U.S. PATENT DOCUMENTS

| | | | |
|---|---|---|---|
| 3,936,183 | 2/1976 | Sadamatsu | 355/299 |
| 3,973,845 | 8/1976 | Lindblad et al. | 355/299 |
| 3,980,494 | 9/1976 | Beatty et al. | 15/256.5 X |
| 4,279,500 | 7/1981 | Kondo et al. | 118/652 |
| 4,301,225 | 11/1981 | Herrmann et al. | 430/66 |
| 4,390,609 | 6/1983 | Wiedemann | 430/66 X |
| 4,415,641 | 11/1983 | Goto et al. | 430/79 |
| 4,451,548 | 5/1984 | Kinoshita et al. | 430/79 |
| 4,469,434 | 9/1984 | Yamazaki et al. | 355/299 |
| 4,535,042 | 8/1985 | Kitayama et al. | 430/83 |
| 4,571,057 | 2/1986 | Koizumi et al. | 355/217 |
| 4,658,756 | 4/1987 | Ito et al. | 118/652 |
| 4,663,259 | 5/1987 | Fujimura et al. | 430/67 X |

FOREIGN PATENT DOCUMENTS

| | | | |
|---|---|---|---|
| 57-5050 | 1/1982 | Japan | 430/66 |
| 59-5259 | 1/1984 | Japan . | |
| 59-90877 | 5/1984 | Japan | 355/211 |
| 59-188655 | 10/1984 | Japan | 430/66 |
| 60-57346 | 4/1985 | Japan | 430/66 |

*Primary Examiner*—Fred L. Braun

*Attorney, Agent, or Firm*—Fitzpatrick, Cella, Harper & Scinto

[57] ABSTRACT

An image-bearing member especially adapted to a very compact electrophotographic apparatus is provided. The image-bearing member has a ratio of the diameter to the length of 1:5 or more, and the surface of the image-bearing member has a relative frictional coefficient against urethane rubber of 0.7 or less with polyethylene terephthalate film as the standard, whereby a cleaning failure and generation of blade scratches on the image-bearing member can be avoided even if it has a small diameter of 45 mm or less. The cleaning effect is ensured if the cleaning blade line pressure is 7 g/cm or higher.

15 Claims, 3 Drawing Sheets

IMAGE-BEARING MEMBER FOR ELECTROPHOTOGRAPHY AND BLADE CLEANING METHOD

This application is a continuation of application Ser. No. 368,887 filed Jun. 20, 1989 now abandoned, which is a continuation of application Ser. No. 912,123 filed Sep. 29, 1986, now abandoned.

FIELD OF THE INVENTION AND RELATED ART

This invention relates to an image forming device utilizing electrostatographic process such as electrophotographic copying machine, printer, etc.

An image forming apparatus, which repeats the steps of forming a transferable toner image on the photoconductive surface layer of an image-bearing member, transferring the toner image onto a transfer material such as paper as a typical example and subsequently removing the residual toner remaining on the image bearing member by cleaning means such as a cleaning blade, has been well known in the art.

The cleaning means to be used for removing the residual toner in this kind of image forming apparatus may include fur brush, magnetic brush, felt, unwoven fabric, blade, etc. Among them, the cleaning system using a rubber blade is compact with light weight and also results in little fog of the image due to cleaning failure, which is also economical and excellent in stability.

As the image carrying member to be used for such an electrophotographic apparatus, there have been known inorganic photosensitive members such as selenium, CdS, ZnO, amorphous silicon, etc., and also organic photosensitive members as follows; namely, organic photoconductive polymers such as poly-N-vinylcarbazole, polyvinylanthracene, etc., low molecular weight organic photoconductive materials such as carbazole, anthracene, pyrazolines, oxadiazoles, hydrazones, polyarylalkanes, etc., organic pigments or dyes such as phthalocyanine pigments, azo pigments, cyanine dyes, polycyclic quinone pigments, perylene type pigments, indigo dyes, thioindigo dyes or squaric acid methine dyes, etc.

There may also be included photoconductive members having a protective layer or an insulating layer provided on these photosensitive layers, and image-bearing members having an insulating layer on the electroconductive substrate.

The shape of the image bearing member may be a sheet, belt, etc., but a seamless cylindrical substrate (hereinafter called "drum") is attracting attention in recent years. This is because the apparatus can be made simple, low in cost and compact for such reasons that no synchronous matching is required during image formation and also that the size of the image-bearing member can be made smaller, etc.

Particularly in recent years, with the progress of miniaturization of electrophotographic apparatus, it has been desired to develop a space-saving type electrophotographic apparatus which is inexpensive and transportable, directed to individual users.

For such purposes, an apparatus using a drum with a small diameter and a blade cleaning system, is the most suitable.

However, as the drum diameter becomes small, variance of the pressing force (line pressure) of the blade against the drum becomes greater unless the mounting precision of the blade with respect to the generatrix direction of the drum is further improved. When the line pressure becomes lower than a certain value, cleaning failure will occur causing image staining. For preventing the above problem, the line pressure as a whole is required to be made greater, whereby the line pressure becomes contrariwise partly too large, thus giving rise to such problems as generation of damage or non-uniform scratches on the image-bearing member surface. For balancing both requirements, improvement of assembling precision may be practiced, but this will result in increase of cost to a great extent. Thus, it has been deemed difficult to use a small diameter drum satisfactorily.

FIG. 1 shows a state in which a rubber blade 20 and a photosensitive drum 10 are mounted. The angle $\theta$ shows the variance in assembling of the blade. FIG. 2 shows the deviation of the contact position of the blade caused by the angle $\theta$. It shows that the blade which is to make a contact at the point A when $\theta=0$, changes the point of contact to the point C when $\theta\neq0$.

Practically, the blade 20 contacts the photosensitive drum 10 at the point B, and therefore, when considered roughly, the line pressure of the blade becomes reduced in amount corresponding to the length shown by x.

As roughly calculated, it may be represented as follows:

$$\overline{AC} = l\theta$$

$l$: length of blade $\approx$ length of drum $\theta$: mounting error $$\angle CAB = \frac{1}{2}\cdot\delta$$

$$r\cdot\delta \approx l\theta$$

$$x = \frac{1}{2}\cdot\delta\cdot l\theta = \frac{1}{2}\cdot\frac{l^2}{r}\cdot\theta^2$$

This calculation is considerably rough, but it indicates that a measure showing the variance of line pressure, namely the size of x, is dependent on l/r, provided that the assembling precision of the blade and the drum is constant.

SUMMARY OF THE INVENTION

An object of the present invention is to provide an electrophotographic apparatus of high quality, low cost and compact size by canceling the cleaning failure and the damage or non-uniform scratch on the image bearing member surface accompanied with increase of variance of the line pressure of a blade which will occur when the diameter of a seamless drum-shaped image-bearing member is attempted to be made smaller, particularly for a small diameter drum with a diameter of 45 mm or less.

Also, for realizing development of a compact size, very low price copying machine or printer, among a large number of various photosensitive members as previously explained, the organic photoconductive member (hereinafter abbreviated as "OPC") is the most suitable.

The first reason is that OPC has no toxicity, namely non-polluting, as compared with selenium, CdS, selenium-tellurium alloy, selenium-arsenic compound, etc., and therefore no recovery of the used image bearing member is required.

The second reason is that it is inexpensive, and it can be produced according to a simple coating method as represented by dipping, spraying, screen printing, gravure printing, etc. Selenium, amorphous silicon, etc., require expensive production installations such as for the vacuum vapor deposition process, the sputtering process, the plasma discharging process, etc., and also the number of drums produced per unit time is small. In contrast, OPC is very low in cost and also good in productivity.

The third reason is that it is excellent in environmental characteristics and durability characteristic. ZnO photosensitive members, etc., while they are low in cost and non-polutional, show poor characteristic in a humid environment and also are particularly inferior with respect to deterioration by light or ozone.

As described above, although OPC is the most suitable as an image bearing member to be used for a compact size copying machine or printer, the surface of OPC is more susceptible to damages and also has greater influences on images, as compared with amorphous silicon or photosensitive members having an insulating layer on the surface. Also, it has a drawback that it has generally a greater frictional coefficient as compared with selenium or ZnO (frictional coefficient is low due to presence of fine unevenness on the surface), etc., so that it presents a difficulty in developing a low cost and very compact size copying machine or printer by use of OPC.

The present invention is intended to provide a solution to such problems.

According to the present invention, there is provided a cylindrical image bearing member for electrophotography to be used in an electrophotographic apparatus having a blade cleaning system, wherein image bearing member has a ratio of the diameter to the length of 1:5 or more, and the surface of the image bearing member has a frictional coefficient against urethane rubber (based on polyethylene terephthalate film as the standard) of 0.7 or less.

Further, the present invention provides a blade cleaning method, which comprises performing blade cleaning under a line pressure of the cleaning blade of 7 g/cm or higher applied on a cylindrical image bearing member for electrophotography having a ratio of the diameter to the length of 1:5 or more and a surface having a frictional coefficient against urethane rubber (based on polyethylene terephthalate film as the standard) of 0.7 or less. The ratio of diameter to length (D:L) can also be expressed as a fraction, i.e. 1:5 is the same as 0.2 or less.

These and other objects, features and advantages of the present invention will become more apparent upon a consideration to the following description of the preferred embodiments of the present invention taken in conjunction with the accompanying drawings.

DETAILED DESCRIPTION OF THE PREFERRED EMBODIMENTS

In a small diameter drum, particularly a small diameter drum having a diameter of 45 mm or less, the surface with a small frictional coefficient in the present invention can give relatively easily the cleaning effect even with a weak blade pressure, whereby cleaning failure can be prevented.

Also, by setting the line pressure of the cleaning blade at 7 g/cm or higher, preferably 10 g/cm or higher, the two problems antagonistic to each other of cleaning failure and generation of image can be solved at the same time without increase in cost.

More specifically, by making the line pressure greater, the cleaning failure caused by partial line pressure reduction on account of assembling variance is solved, and also by making the frictional coefficient of the image carrying member surface smaller, frictional resistance between the blade and the image-bearing member is alleviated, whereby such problems as damage on the image-bearing member surface or non-uniform scratch caused by partial increase in line pressure according to assembling variance due to increased line pressure can be solved.

The frictional coefficient referred to herein was measured according to the following method. The measuring instrument was prepared by modifying a surface characteristic tester Model 14 produced by Heidon Co. so as to be adapted to measurement for a drum-shaped sample (FIG. 4).

Figure 4:
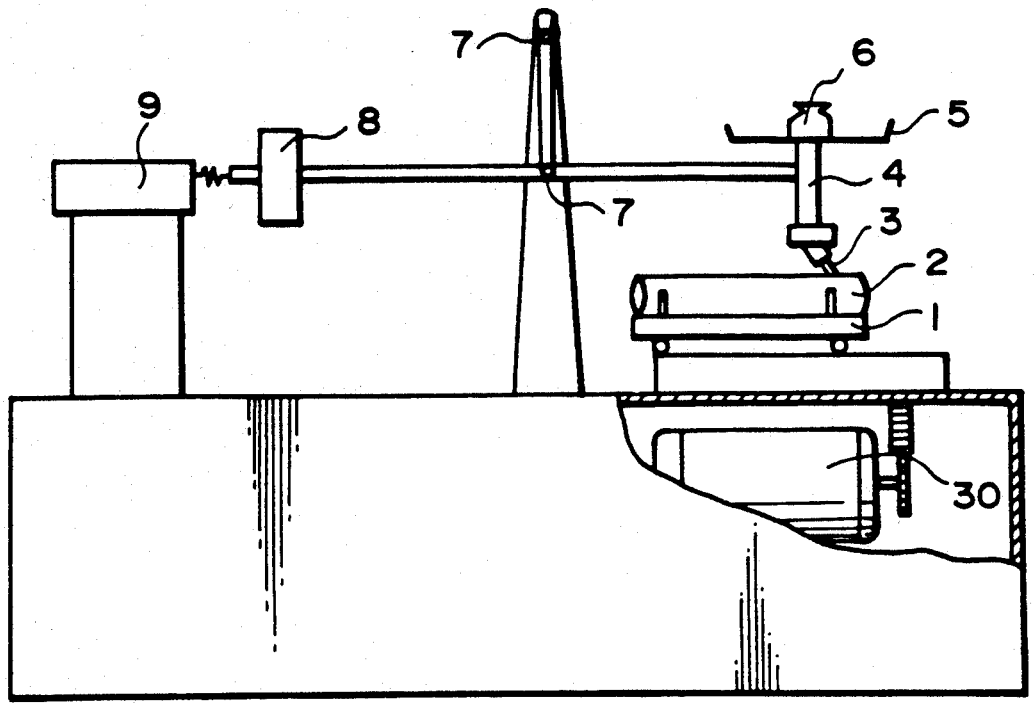
FIG. 4 is a schematic illustration of an instrument for measuring frictional coefficient (Heidon Model 14) used for the present invention.
Figure 6:
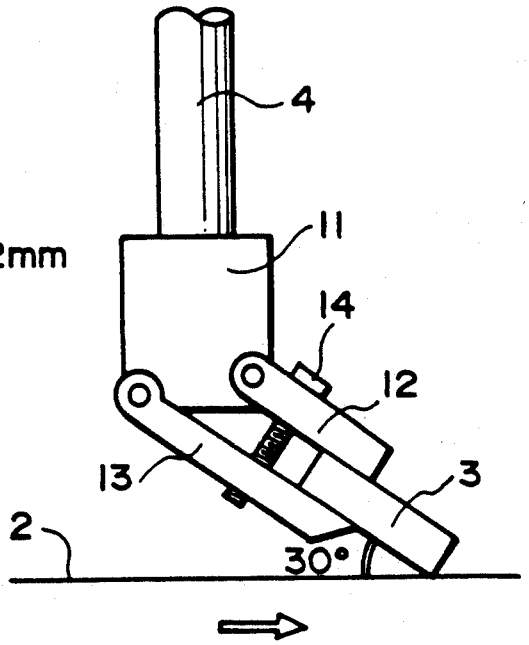
FIG. 6 shows an enlarged view of the contact portion between the urethane rubber blade in FIG. 4 and a sample for measurement of a frictional coefficient.

The measuring instrument was provided with a sample stand 1, a sample 2, a blade 3, a supporting piller 4, a receiving tray 5, a weight 6, a supporting point 7, a balancer 8, a load converter 9, a motor 10, a holder-supporting arm 11, upper holder 12, a lower holder 13, and a fixing screw 14 (FIG. 4 and FIG. 6). As the sample 2, either a drum-shaped sample or a flat plate sample can be applied to measurement.

Figure 5:
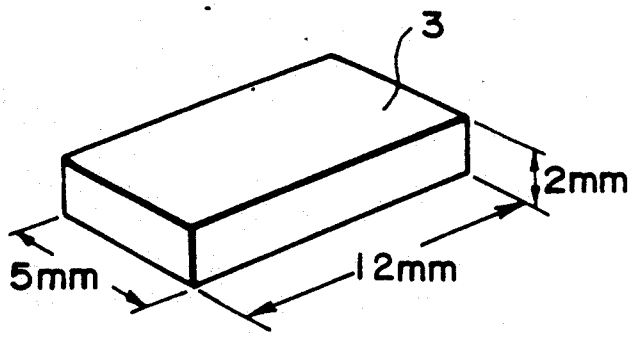
FIG. 5 shows a shape of a urethane rubber blade.

For measurement, a urethane rubber blade 3 was used. The urethane rubber (Bankoran, produced by Bando Kagaku K.K.) had a rubber hardness of 65±3°, and was formed into a blade with dimensions of 5 mm in width, 12 mm in length, 8 mm in free length and 2 mm in thickness (FIGS. 5 and 6). The blade 3 was held to form an angle of 30° with the sample 2 (FIG. 6) and a load of 10 g was applied by the weight 6. The sample drum on which the sample 2 was wound was moved in the same direction as the projection of the blade 3 and in the direction of the generatrix. The pulling force exerted to the converter 9 at this time was read as the frictional force. Also, as the standard sample, by use of a 25μ polyethylene terephthalate (polyester, e.g., Mylar) film, which was wound up on a cylinder with the same diameter as the sample, frictional force was measured under entirely the same conditions. The frictional coefficient was calculated from the following formula:

$$\text{Frictional coefficient} = \frac{\text{Frictional force for sample}}{\text{Frictional force for polyester}}$$

The frictional force is based on a substantially smooth polyester film, and therefore it is not influenced by more or less variance in measuring conditions. Also, it will not be influenced by the diameter of the photosensitive drum to indicate a constant value. The following scopes of conditions are permissible:

Urethane rubber:

hardness 62°–70°, thickness 1–5 mm, manufacturers other than Bando Kagaku K.K., include Hokushin Rubber K.K., Tokai Rubber K.K., etc.;

Supplier (Trade name) of polyethylene terephthalate film:

Toray (Rumilar), Teijin, Du Pont (Mylar), etc.; thickness 10–50μ;

Drum diameter:

20–160 mm (frictional coefficient based on polyester is not changed even if the drum diameter may be varied).

The line pressure of the cleaning blade in the present invention is defined as the value of the total load applied on the blade (g) divided by the total length (cm) at which the blade contacts the photosensitive member surface.

Figure 1:
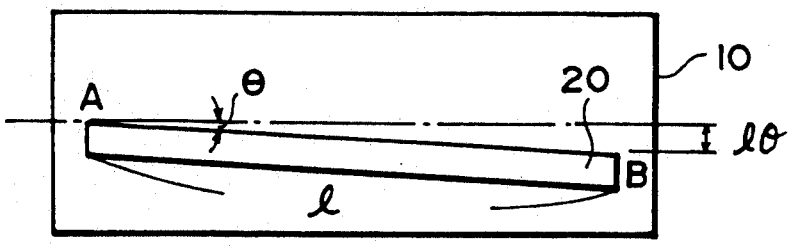
FIG. 1 shows a positional relationship of a cleaning blade contacting a photosensitive drum, as observed from above the blade.
Figure 2:
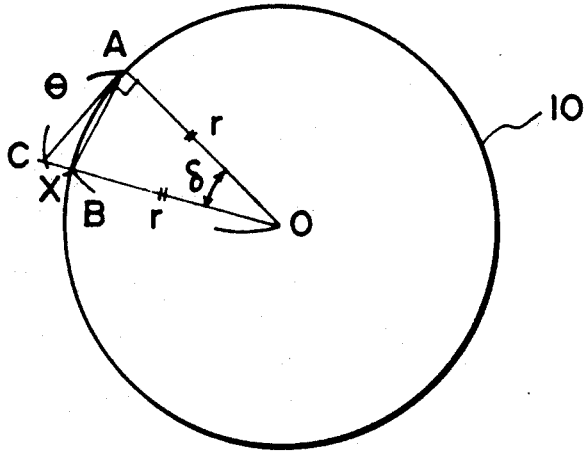
FIG. 2 shows the state as observed in the lateral direction.
Figure 3:
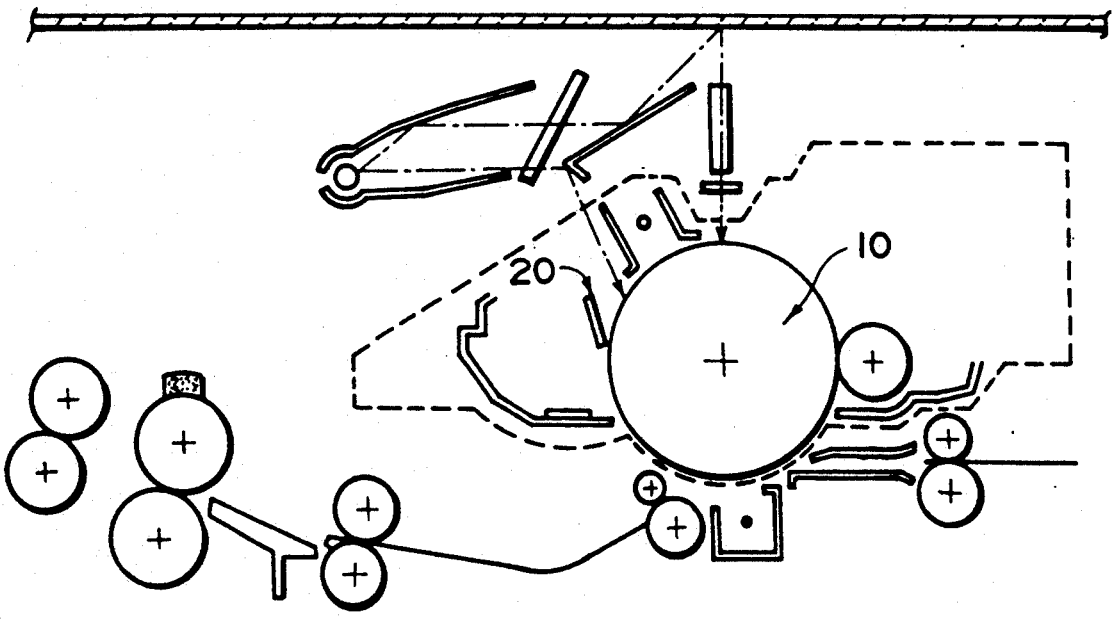
FIG. 3 schematically illustrates an electrophotographic apparatus used for the present invention.

As the cleaner blade to which the present invention is applicable, a rubber blade in shape of a plate, a composite blade of a rubber blade and a metal plate (so-called "tip blade"), or a blade with a different shape of which the tip angle, the plate thickness, etc., have been changed into various forms, etc., may be conceivable. The blade 2 may be mounted in either the counter direction as shown in FIG. 3, or contrariwise in the same direction.

As the material of the rubber blade, urethane rubber, fluorine rubber, silicone rubber, acrylic rubber, isobutylene-isoprene rubber, polyisobutylene rubber, chlorosulfonated polyethylene rubber, acrylonitrile rubber, butadiene type rubber, styrene type rubber or composite of these materials may be employed.

As the photosensitive member for which the present invention can be effectively applied, inorganic photoconductive members such as selenium, zinc oxide, cadmium sulfide, amorphous silicon, selenium-tellurium, selenium-arsenic, etc., and organic photoconductive members as shown below, may be employed.

Particularly organic photoconductive members can be effectively used.

Variations in layer structure of OPC may include the following:

(1) The so-called monolayer type containing a charge-transportation material (hereinafter called CT material) and a charge generation material (hereinafter called "CG material") within the same layer in a binding material (hereinafter called "binder") on an electroconductive substrate;

(2) The function-separation type having a charge transportation layer (CTL) provided on a charge generation layer (CGL);

(3) The function-separation type having a CGL provided on a CTL;

(4) The composite layer type of (1)–(3);

(5) Those of (1)–(4) having at least one intermediate layer (having the function of a barrier layer, adhesive layer, etc.) provided between the respective layers;

(6) Those of (1)–(5) having a protective layer or an insulating layer as the uppermost layer;

(7) Those of (1)–(6) containing a CT material in at least one layer of the respective layers other than CTL.

Ordinary image bearing members having a large frictional coefficient against a rubber blade. For image-bearing members having no binder such as selenium, amorphous silicon, etc., a lubricant material can be externally imparted to the surface, but there are involved drawbacks such that the apparatus becomes complicated, that the lubricity is not persistent, etc., therefore, it is effective to provide a protective layer or an insulating layer composed mainly of an organic binder in which a lubricant material is contained.

On the other hand, in the case of an image-bearing member, whether it may be organic or inorganic containing a binder, it is effective to incorporate a lubricant material in the binder.

To describe specifically about OPC, a lubricant material may be incorporated in the uppermost layer of the various layer constitutions (1)–(7) as mentioned above.

The charge transportation layer of the present invention can contain positive hole-transporting substances, including electron-attracting substances such as chloroanil, bromoanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, 2,4,8-trinitrothioxanthone and polymers of these electron attracting substances, or pyrene; carbazoles such as N-ethylcarbazole, N-isopropylcarbazole, N-methyl-N-phenylhydrazino-3-methylidene-9-ethylcarbazole, N,N-diphenylhydrazino-3-methylidene-9-ethylcarbazole; N,N-diphenylhydrazino-3-methylidene-10-ethylphenothiadine; N,N-diphenylhydrazino-3-methylidene-10-ethylphenoxadine; hydrazones such as p-diethylaminobenzaldehyde-N,N-diphenylhydrazone, p-diethylamino-benzaldehyde-N-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzthiazolinone-2-hydrazone, etc.; pyrazolines such as 2,5-bis(p-diethylaminophenyl)-1,3,4-oxadiazole, 1-phenyl-3-(p-diethylaminostyryl)-5-(p-diethylaminophenyl)pyrazoline, 1-[quinolyl(2)]-3-(p-diethylaminostyryl)-5-(p-diethylaminophenyl)pyrazoline, 1-[pyridyl(2)]-3-(p-diethylaminostyryl)-5-(p-diethylaminophenyl)pyrazoline, 1-[6-methoxy-pyridyl(2)]-3-(p-diethylaminostyryl)-5-(p-diethylaminophenyl)pyrazoline, 1-[pyridyl(3) -3-(p-diethylaminostyryl)-5-(p-diethylaminophenyl)pyrazoline, 1-[lepidyl(2)]-3-(p-diethylaminostyryl)-5-(p-diethylaminophenyl)pyrazoline, 1-[pyridyl(2)]-3-(p-diethylaminostyryl)-4-methyl-5-(p-diethylaminophenyl)pyrazoline, 1-[pyridyl(2)]-3-(α-methyl-p-diethylaminostyryl)-5-(p-diethylaminophenyl)pyrazoline, 1-phenyl-3-(p-diethylaminostyryl)-4-methyl-5-(p-diethylaminophenyl)pyrazoline, 1-phenyl-3-(α-benzyl-p-diethylaminostyryl)-5-(p-diethylaminophenyl)pyrazoline, spiropyrazoline, etc.; oxazole type compounds such as 2-(p-diethylaminostyryl)-6-diethylaminobenzoxazole, 2-(p-diethylaminophenyl)-4-(p-dimethylaminophenyl)-5-(2-chlorophenyl)oxazole, etc.; thiazole type compounds such as 2-(p-diethylaminostyryl)-6-diethylaminobenzothiazole, etc.; triarylmethane type compounds such as bis(4-diethylamino-2-methylphenyl)phenylmethane, etc.; polyarylalkanes such as 1,1-bis(4-N,N-diethylamino-2-methylphenyl)heptane, 1,1,2,2-tetrakis-(4-N,N-dimethylamino-2-methylphenyl)ethane, etc.; triphenylamine; poly-N-vinylcarbazole; polyvinylpyrene; polyvinylanthracene; polyvinylacridine; poly-9-vinylphenylanthracene; pyrene-formaldehyde resin; ethylcarbazole formaldehyde resin, etc.

Also, these charge-transportation substances may be used as a combination of two or more kinds. The charge transportation layer can be formed by applying a solution of a charge-transportation substance as mentioned above and a benzophenone type compound together with a binder resin dissolved in an appropriate solvent, followed by drying. In this instance, the benzophenone type compound may also be previously contained in the binder resin, or the coating film after the application may be dipped in a solution of the benzophenone type compound, which is thus to be incorporated near the surface of the coating, particularly only-near the surface of about 5 μm by dipping.

Examples of the binder resin to be used in the charge transportation layer may include polyallylate resins, polysulfone resins, polyamide resins, acrylic resins, acrylonitrile resins, methacrylic resins, vinyl chloride resins, vinyl acetate resins, phenol resins, epoxy resins, polyester resins, alkyd resins, polycarbonate, polyurethane or a copolymer resins containing two or more of the recurring units of these resins, such as styrene-butadiene copolymers, styrene-acrylonitrile copolymers, styrene-maleic acid copolymers, etc. Also, other than such insulating polymers, organic photoconductive polymers such as polyvinylcarbazole, polyvinylanthracene or polyvinylpyrene may be used.

The charge transportation layer has a limitation in distance in which charge carriers can be transported, and therefore the film thickness cannot be made thicker than is necessary. Generally, it may be 5 to 50 μm, but the preferable range is from 8 to 30μ. Formation of a charge transportation layer by way of application may be practiced according to the coating method such as dip coating, spray coating, spinner coating, bead coating, wire bar coating, blade coating, roller coating, curtain coating, etc.

In the charge transportation layer of the present invention, various additives can be contained. Examples of such additives may include diphenyl, diphenyl chloride, o-terphenyl, p-terphenyl, dibutyl phthalate, dimethyl glycol phthalate, dioctyl phthalate, triphenylphosphoric acid, methylnaphthalane, benzophenone, chlorinated paraffin, dilauryl thiopropionate, 3,5-dinitrosalicylic acid, various fluorocarbons, etc.

The charge generation layer to be used in the present invention may comprise a separate vapor deposition layer of or a resin-dispersed layer of a charge generation substance, selected from selenium, seleniumtellurium, pyrylium, thiopyrylium type dyes, phthalocyanine type pigments, anthanthrone pigments, dibenzpyrenequinone pigments, pyranthrone pigments, trisazo pigments, disazo pigments, azo pigments, indigo pigments, quinacridone type pigments, asymmetric quinocyanine, quinocyanine, or amorphous silicon as described in Japanese Laid-Open Patent Application No. 143645/1979. The resin can be selected from the same scope as used for the charge transportation layer.

The charge generation layer, in order to obtain a sufficient light absorbance, should preferably contain as much amount of the above organic photoconductive material as possible, and be made a thin film layer having a film thickness preferably of 0.05 to 20 μm. The charge generation layer is generally provided between the charge transportation layer and the electroconductive layer, but it may also be provided on the charge transportation layer.

The photosensitive layer comprising such a laminated structure of the charge generation layer and the charge transportation layer is provided on a substrate having an electroconductive layer.

Figure 7A:
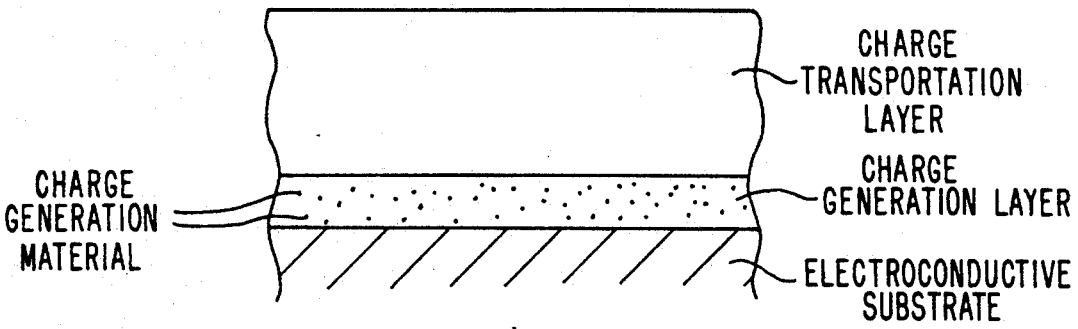
FIGS. 7A and 7B schematically illustrate a laminated structure having a charge generation layer and a charge transportation layer.
Figure 7B:
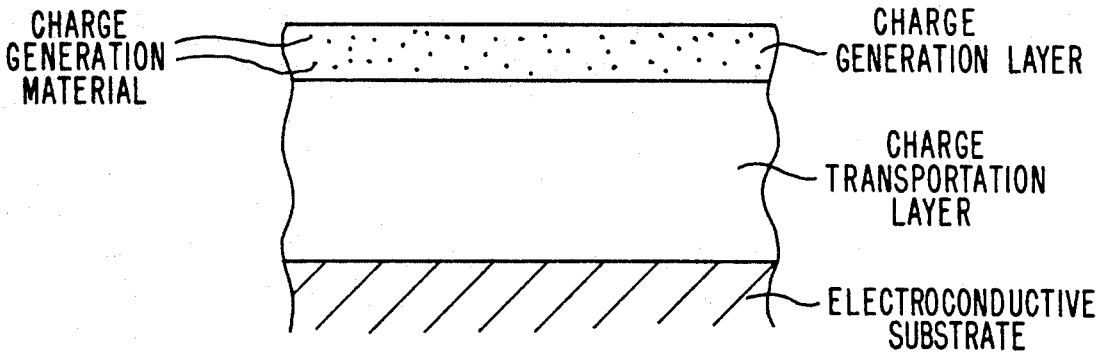

FIG. 7A illustrates a photosensitive layer in which a charge transportion outer layer is laminated to a charge generation layer which, in turn, is supported by an electroconductive substrate. FIG. 7B illustrates a photosensitive layer in which a charge generation outer layer is laminated to a charge transportion layer which, in turn, is supported on an electroconductive substrate. As the substrate having an electroconductive layer, those of which the substrate itself has an electroconductivity, for example, aluminum, aluminum alloys, copper, zinc, stainless steel, vanadium, molybdenum, chromium, titanium, nickel, indium, gold or platinum, can be employed. Otherwise, it is also possible to use plastics (e.g., polyethylene, polypropylene, polyvinyl chloride, polyethylene terephthalate, acrylic resin, polyfluoroethylene, etc.) having a coating layer of aluminum, aluminum alloys, indium oxide, tin oxide, indium oxide-tin oxide alloys, etc., according to the vacuum vapor deposition method; substrates of plastics having a coating of electroconductive particles (e.g., carbon black, silver particles, etc.) together with a suitable binder; or substrates of plastics or papers impregnated with electroconductive particles or plastics comprising electroconductive polymers.

Between the electroconductive layer and the photosensitive layer, a primer layer having a barrier function and an adhesive function can be also provided. The primer layer may be formed from casein, polyvinyl alcohol, nitrocellulose, ethylene-acrylic acid copolymers, polyamides (nylon 6, nylon 66, nylon 610, copolymer nylon, alkoxymethylated nylon, etc.), polyurethane, gelatin, aluminum oxide, etc.

The film thickness of the primer layer may be suitably 0.01 to 30 μm, preferably 0.2 to 5 μm. The protective layer, used as desired in the present invention, can be formed by applying a solution of a resin such as polyvinylbutyral, polyester, polycarbonate, acrylic resin, methacrylic resin, nylon, polyimide, polyarylate, polyurethane, styrene-butadiene copolymer, styrene-acrylic acid copolymer, styrene-acrylonitrile copolymer, etc., dissolved in an appropriate organic solvent on the photosensitive layer, followed by drying. In this case, the film thickness of the protective layer is generally 0.05 to 20 μm, particularly preferably 0.2 to 5 μm.

In the protective layer, UV-ray absorbers, etc., can also be contained.

As the lubricating material to be used in the present invention, the following materials may be included:

organic polymer powder such as of polytetrafluoroethylene, polyvinyl fluoride, polyvinylidene fluoride, polyethylene, polyethylene terephthalate, polybutylene terephthalate, polyvinyl chloride, nylon, polypropylene, polyoxymethylene, etc.;

solid lubricants such as graphite, molybdenum disulfide, BN, SiN, $Sb_2O_3$, mica, $CdCl_2$, phthalocyanine, graphite fluoride, ZnS, ZnO, etc.;

hydrocarbon type lubricants such as fluid paraffin, microwax (paraffin), low molecular-weight polyethylene wax, etc.; fatty acid type lubricants such as stearic acid, lauric acid, etc.; fatty acid amide type lubricants such as stearic acid amide, palmitic acid amide, methylenebisstearoamide, etc.; ester type lubricants such as ethyleneglycol monostearate, butyl stearate, hardened castor oil, etc.; alcohol type lubricants such as cetyl alcohol, stearyl alcohol, etc.; metal soap such as zinc stearate, lead stearate, etc.;

synthetic lubricants such as silicone, chlorinated biphenyl, fluoroester, polychlorotrifluoroethylene, phosphate ester, polyphenyl ether, polyglycolsilicon type graft polymer, fluorinated graft polymer, etc.

These lubricants may be used either singly or as a combination of two or more kinds.

The present invention enables practical application of a photosensitive drum with small diameter (with a ratio of diameter:length of 1:5 or more) which can be used fully with difficulty in the prior art, particularly solves instability accompanied with the blade system cleaning due to small diameter, and enables development of an electrophotographic device of high quality, low cost and miniature size.

The present invention is described below with reference to Examples.

EXAMPLE 1

On a cylindrical substrate made of aluminum (aluminum cylinder) having a diameter of 45 mm and a length of 250 mm (diameter:length=1:5.6), a photoconductive layer was provided according to the following procedure.

A solution of 10 parts of a solvent-soluble copolymer-nylon (CM-8000, produced by Toray K.K.) dissolved in a mixture of 60 parts of methanol and 40 parts of butanol was applied by dip coating on the above substrate and dried at 60° C. for 10 minutes to provide a primer layer with a film thickness of 1 μm. Subsequently, a solution of 5 parts of a hydrazone compound represented by the structural formula:

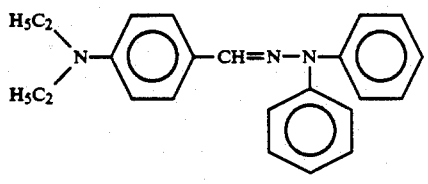

and 5 parts of polymethyl methacrylate resin (number-average molecular weight 100,000) dissolved in 70 parts of benzene was applied by dip coating on the above primer layer to a film thickness after drying of 12 μm to form a charge transportation layer.

Next, into a solution of 5 parts of a polymethacrylate resin (number-average molecular weight 10,000) dissolved in 800 parts of monochlorobenzene, 1 part of tetrafluoroethylene resin powder (Daikin-polyflon TFT Low-Polymer, produced by Daikin Kogyo K.K.) and 1 part of a disazo pigment represented by the following structural formula:

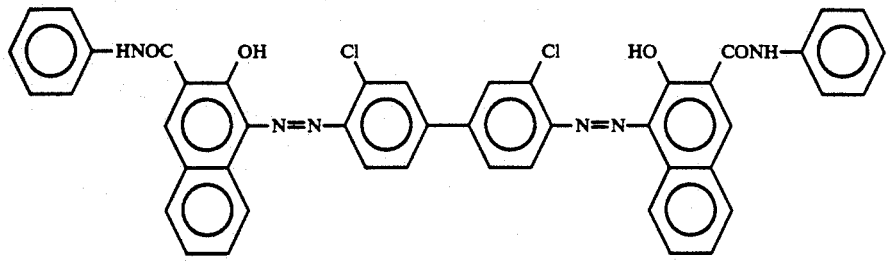

were added and dispersed by means of a sand mill for 10 hours. The dispersion was applied by dip coating on the charge transportation layer previously formed to provide a charge generation layer with a dried film thickness of 5 μm, thus preparing an electrophotographic photosensitive drum. The frictional coefficient of the surface of this photosensitive drum was found to be 0.4 with a polyethylene terephthalate film (having an absolute frictional coefficient of 1.2 (=12 g-frictional force/10 g-load)) as the standard.

COMPARATIVE EXAMPLES 1 AND 2

Also, according to entirely the same procedure as described above except for using a charge generation layer containing no tetrafluoroethylene resin powder, an electrophotographic photosensitive drum was prepared. The frictional coefficient of the surface of this drum was found to be 1.6.

Also, as Comparative Example 2, entirely the same electrophotographic photosensitive drum as Comparative Example 1 except for using an aluminum cylinder with a diameter of 60 mm and a length of 250 mm (diameter:length=1:4.2) was prepared. The frictional coefficient was 1.6.

For the electrophotographic photosensitive drum thus prepared, by use of an electrophotographic device as shown in FIG. 3, image evaluations were performed at the initial stage and after a successive copying test.

The experiments were carried out under a line pressure of the cleaning blade of 5 g/cm.

Other conditions in these experiments are shown below.

① Preexposure by a halogen lamp; ② primary charging by corona discharging, +200 μA, Vd (dark portion potential) +650 V; ③ image exposure by a halogen lamp, 3 lux sec; ④ developing according to the jumping method, toner of negative polarity used; ⑤ transfer charging by corona discharging, +300 μA; ⑥ cleaning with a urethane rubber blade (produced by Hokushin Rubber K.K., t=2.0 mm, rubber hardness=70 according to the JIS-A method).

| | Experimental results | |
|---|---|---|
| | Blade line pressure | Initial image |
| Example 1 | 5 g/cm | Good |
| Comparative Example 1 | 5 g/cm | Cleaning failure occurred |
| Comparative Example 2 | 5 g/cm | Good |

As can be seen from the above results, there was no problem when the ratio of diameter:length was 1:4.2 under a line pressure of 5 g/cm (Comparative Example 2), but cleaning failure was caused under a line pressure of 5 g/cm when a small drum with the ratio of 1:5.6 was used (Comparative Example 1). In contrast, in the case of the frictional coefficient of the surface of the photosensitive drum of 0.4 (Example 1), there was no problem at all.

EXAMPLE 2

Entirely the same photosensitive drum as Example 1 except for using an aluminum cylinder of a diameter of 30 mm and a length of 250 mm (diameter: length = 1:8.3) was prepared.

Also, as Comparative Example 3, a photosensitive drum was prepared according to entirely the same procedure as Comparative Example 1 except for using the above aluminum cylinder.

These photosensitive drums were compared under entirely the same conditions as in Example 1. However, in this case, the line pressure of the cleaning blade was varied in the range of 5–15 g/cm.

| | Blade line pressure | Experimental results: Initial image | Experimental results: Durability |
|---|---|---|---|
| Example 2 | 5 g/cm | Fog on white ground by cleaning failure partially occurred | Cleaning failure worsened after continuous use for 1000 sheets |
| | 7 | The same as above | Cleaning failure worsened after continuouse use for 5000 sheets |
| | 10 | Good | Good after continuous use for 20000 sheets |
| | 15 | Good | Good after continuous use for 20000 sheet |
| Comparative Example 3 | 5 | Fog on white ground by cleaning failure occurred | |
| | 7 | Cleaning failure partially occurred | Cleaning failure worsened after continuous use for 20000 sheets |
| | 10 | Good | Black streaks (flaws) generated on image after continuous use for 20000 sheets |
| | 15 | Good | Black streaks (flaws) generated on image after continuous use for 500 sheets |
| Comparative Example 2 | 5 | Good | Good after continuous use for 20000 sheets |

As shown in the above Table, the results were entirely good under a line pressure of 5 g/cm when the ratio of diameter:length = 1:4.2 (Comparative Example 2), but cleaning failure occurred in the case of 1:8.3 (Comparative Example 3). In this case, although the cleaning failure could be solved by increasing the line pressure, image flaws caused by large blade pressure were formed on the photosensitive drum after repeated uses.

In the case of Example 2, when the line pressure was 5 g/cm, the extent of unsatisfactory cleaning was improved because of small frictional coefficient of the photosensitive drum surface, but this cannot necessarily be said to be satisfactory. This is because the ratio of diameter:length of the photosensitive drum was further increased (in terms of length/diameter) as compared with Example 1.

In this case, if the line pressure was made 7 g/cm or higher, the problem of cleaning failure was alleviated, and further the photosensitive member could stand successive copying of 20,000 sheets or more if the line pressure was made 10 g/cm or higher.

EXAMPLE 3

On an aluminum cylinder with a diameter of 30 mm and a length of 320 mm (diameter:length = 1:10.7), a primer layer was provided according to the same procedure as in Example 1.

Subsequently, into a solution of 5 parts of an acrylstyrene copolymer resin (MS-200, produced by Shinnittetsu Kagaku K.K.) dissolved in 800 parts of monochlorobenzene, 1 part of a disazo pigment represented by the following structural formula:

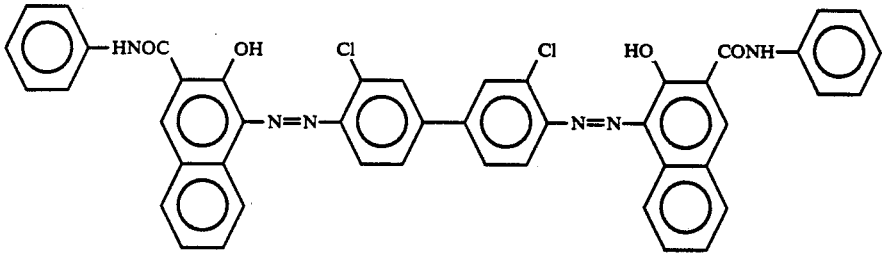

was added and dispersed therein by means of a sand mill for 10 hours. The dispersion was applied by dip coating on the primer layer previously formed and dried at 90° C. for 10 minutes to provide a charge generation layer with a film thickness of 5 μm.

Next, 5 parts of a hydrazone compound represented by the structural formula:

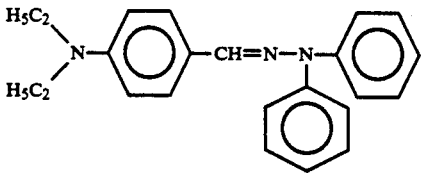

and 5 parts of a polymethyl methacrylate resin (number-average molecular weight 100,000) were dissolved in 70 parts of benzene, and the solution was applied by dip coating on the above charge generation layer to a film thickness after drying of 12 μm and dried at 100° C. for 20 minutes to provide a charge transportation layer.

Next, into a solution of 5 parts of bisphenol A type polycarbonate resin (panlite L-1250, produced by Teijin K.K.) dissolved in 500 parts of tetrahydrofuran, 1 part of the same tetrafluoroethylene resin powder as in Example 1 was added and dispersed by means of a sand mill for 2 hours. The dispersion was applied by dip coating on the charge transportation layer previously formed, dried at 90° C. for 30 minutes to provide a protective layer of 4 μm, thus preparing a photosensitive drum. The frictional coefficient of the drum surface was found to be 0.5.

Also, as Comparative Example 4, the same photosensitive drum as Example 3 except for containing no tetrafluoroethylene resin powder was prepared. The frictional coefficient of this drum was found to be 1.3.

These photosensitive drums were subjected to comparison according to the same procedure as in Example 2.

| | Blade line pressure | Experimental results: Initial image | Experimental results: Durability |
|---|---|---|---|
| Example 3 | 5 g/cm | Cleaning failure occurred on the whole surface | |
| | 7 | Cleaning failure partially occurred | |
| | 10 | Good | Good after continuous use for 20000 sheets |
| | 15 | Good | The same as above |
| Comparative Example 4 | 5 | Cleaning failure occurred on the whole surface | |
| | 7 | The same as above | |
| | 10 | Good | Black streaks generated on image after continuous use for 5000 sheets |
| | 15 | Good | Black streaks generated on image after continuous use for 1500 sheets |

From the above results, it was found to be effective to cope even with a case where a protective layer was provided on the photosensitive drum based on the same way of consideration as in Example 2.

EXAMPLE 4

In Example 1, the amount of the tetrafluoroethylene resin powder formulated in the charge generation layer was changed to 0, 0.2, 0.4 and 0.7 part, respectively, to prepare photosensitive drums. These drums were evaluated according to the same procedure as in Example 2 to obtain the results shown below. However, the blade pressure was changed to 7 g/cm.

| Amount of tetrafluoroethylene resin powder added | Frictional coefficient | Initial image | Durability |
|---|---|---|---|
| 0 | 1.6 | Cleaning badness partially generated | |
| 0.2 | 0.9 | Good | Cleaning failure occurred after successive copying of 3000 sheets |
| 0.4 | 0.7 | Good | Good after successive copying of 10000 sheets |
| 0.7 | 0.5 | Good | Good after successive copying of 10000 sheets |

From the above results, it was found that images free from cleaning failure and also excellent in durability could be obtained when the frictional coefficient was 0.7 or less.

What is claimed is:

1. A cylindrical image-bearing member for electrophotography to be used in an electrophotographic apparatus having a blade cleaning system, wherein said image-bearing member has a ratio of the diameter to the length of 1:5 or more, and the surface of said image-bearing member having a frictional coefficient against urethane rubber, based on polyethylene terephthalate film as the standard, of 0.9 or less, said image-bearing member comprising an organic photoconductive material and having a diameter of 45 mm or less and wherein said image-bearing member has an uppermost layer comprising a thermoplastic binder resin matrix.

2. An image-bearing member according to claim 1, which comprises a function-separation type organic photoconductive material.

3. An image-bearing member according to claim 1, which has a laminated structure comprising a charge generation layer and a charge transportation layer.

4. An image-bearing member according to claim 1, wherein the uppermost layer contains a lubricating material.

5. An image-bearing member according to claim 1, wherein the surface of the image-bearing member has a frictional coefficient of 0.7 or less.

6. A blade cleaning method, which comprises performing blade cleaning under a line pressure of 7 g/cm or higher applied against a cylindrical image-bearing member for electrophotography which has a ratio of the diameter to the length of 1:5 or more, and a surface with a frictional coefficient against urethane rubber, based on polyethylene terephthalate film as the standard, of 0.9 or less, said image-bearing member comprising an organic photoconductive material and having a diameter of 45 mm or less and wherein said image-bearing member has an uppermost layer comprising a thermoplastic binder resin matrix.

7. A blade cleaning method according to claim 6, including employing the image-bearing member formed from a function-separation type organic photoconductive material.

8. A blade cleaning method according to claim 6, including employing the image-bearing member having a laminated structure comprising a charge generation layer and a charge transportation layer.

9. A blade cleaning method according to claim 6, including employing an image-bearing member wherein the uppermost layer contains a lubricating material.

10. A blade cleaning method according to claim 6, wherein the surface of the image-bearing member has a frictional coefficient of 0.7 or less.

11. A cylindrical image-bearing member for electrophotography to be used in an electrophotographic apparatus having a blade cleaning system, wherein said image-bearing member has a ratio of the diameter to the length of 1:5 or more; the surface of said image-bearing member having a frictional coefficient against urethane rubber, based on polyethylene terephthalate film as the standard, of 0.9 or less;, said image-bearing member comprising an organic photoconductive material; the surface layer of said image-bearing member comprising a lubricating material and said image-bearing member having a diameter of 45 mm or less and wherein said image-bearing member has an uppermost layer comprising a thermoplastic binder resin matrix.

12. An image-bearing member according to claim 11, wherein the surface of the image-bearing member has a frictional coefficient of 0.7 or less.

13. An electrophotographic apparatus, comprising a cylindrical image-bearing member and a blade cleaning system, wherein said image-bearing member has a ratio of the diameter to the length of 1:5 or more, and the surface of said image-bearing member having a frictional coefficient against urethane rubber, based on polyethylene terephthalate film as the standard, of 0.9 or less, said image-bearing member comprising an organic photoconductive material and having a diameter of 45 mm or less and wherein said image-bearing member has an uppermost layer comprising a thermoplastic binder resin matrix.

14. An electrophotographic apparatus according to claim 13, wherein the surface of the image-bearing member has a frictional coefficient of 0.7 or less.

15. An electrophotographic apparatus according to claim 13, wherein said image-bearing member comprises a function-separation type organic photoconductive material.

* * * * *